US009297533B2

(12) United States Patent
Melton et al.

(10) Patent No.: US 9,297,533 B2
(45) Date of Patent: Mar. 29, 2016

(54) COMBUSTOR AND A METHOD FOR COOLING THE COMBUSTOR

(71) Applicant: General Electric Company, Schenectady, NY (US)

(72) Inventors: Patrick Benedict Melton, Horse Shoe, NC (US); Bryan Wesley Romig, Simpsonville, SC (US); Lucas John Stoia, Taylors, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 721 days.

(21) Appl. No.: 13/663,730

(22) Filed: Oct. 30, 2012

(65) Prior Publication Data

US 2014/0116060 A1 May 1, 2014

(51) Int. Cl.

| | |
|---|---|
| ***F02G 3/00*** | (2006.01) |
| ***F23R 3/28*** | (2006.01) |
| ***F23D 11/36*** | (2006.01) |
| ***F23D 14/78*** | (2006.01) |

(52) U.S. Cl.

CPC ..... *F23R 3/283* (2013.01); *F23D 11/36* (2013.01); *F23D 14/78* (2013.01); *F23D 2214/00* (2013.01); *F23R 2900/03043* (2013.01); *F23R 2900/03044* (2013.01)

(58) Field of Classification Search

CPC ..... F23R 3/283; F23R 2900/03043; F23R 2900/03044; F23D 14/78; F23D 11/36; F23D 2214/00

USPC ..... 60/737, 746, 747, 748, 756, 760, 750

See application file for complete search history.

(56) References Cited

U.S. PATENT DOCUMENTS

| | | | | |
|---|---|---|---|---|
| 3,851,467 | A * | 12/1974 | Sherman | F23R 3/26 417/196 |
| 5,274,991 | A | 1/1994 | Fitts | |
| 5,319,923 | A * | 6/1994 | Leonard | F23C 7/06 60/39.23 |
| 5,357,745 | A | 10/1994 | Probert | |
| 6,923,002 | B2 | 8/2005 | Crawley et al. | |
| 8,281,596 | B1 * | 10/2012 | Rohrssen | F23R 3/002 60/737 |
| 2003/0000216 | A1 * | 1/2003 | Akagi | F23R 3/002 60/746 |
| 2005/0268614 | A1 | 12/2005 | Widener | |
| 2006/0107667 | A1 * | 5/2006 | Haynes | F23R 3/286 60/776 |
| 2009/0188255 | A1 | 7/2009 | Green et al. | |

(Continued)

OTHER PUBLICATIONS

EP Search Report and Written Opinion dated Dec. 20, 2013, issued in connection with corresponding EP Patent Application No. 13190090.4.

*Primary Examiner* — Charles Freay
(74) *Attorney, Agent, or Firm* — Dority & Manning, PA

(57) ABSTRACT

A combustor includes a first shroud extending circumferentially inside the combustor and at least partially defining an inlet passage. A second shroud extends circumferentially inside the combustor. The second shroud defines an outlet passage. A first plate extends radially inside the second shroud downstream from the inlet passage of the first shroud and upstream from the outlet passage of the second shroud. The first plate generally defines an inlet port and an outlet port. A second plate extends radially around the first plate downstream from the inlet port and upstream from the outlet port of the first plate. A first fluid flow path extends from the inlet passage to the inlet port. A second fluid flow path extends from the outlet port to the outlet passage. A baffle extends from the first shroud to the first plate. The baffle separates the first and second fluid flow paths.

20 Claims, 5 Drawing Sheets

(56) References Cited

U.S. PATENT DOCUMENTS

| | | | | |
|---|---|---|---|---|
| 2010/0050640 | A1 | 3/2010 | Belsom et al. | |
| 2010/0162713 | A1 | 7/2010 | Li et al. | |
| 2010/0170251 | A1* | 7/2010 | Davis, Jr. | F02C 7/228 60/740 |
| 2010/0242493 | A1 | 9/2010 | Cihlar et al. | |
| 2011/0061389 | A1* | 3/2011 | Zuo | F23C 7/006 60/737 |
| 2011/0197586 | A1 | 8/2011 | Berry et al. | |
| 2012/0060511 | A1 | 3/2012 | Zuo et al. | |
| 2012/0099960 | A1* | 4/2012 | Bathina | F23R 3/283 415/1 |
| 2012/0304652 | A1* | 12/2012 | Crawley | F01D 9/023 60/740 |

* cited by examiner

COMBUSTOR AND A METHOD FOR COOLING THE COMBUSTOR

FIELD OF THE INVENTION

The present invention generally involves a combustor and method for cooling the combustor.

BACKGROUND OF THE INVENTION

Gas turbines often include a compressor, a number of combustors, and a turbine. Typically, the compressor and the turbine are aligned along a common axis, and the combustors are positioned between the compressor and the turbine in a circular array about the common axis. In operation, the compressor creates a compressed working fluid, such as compressed air, which is supplied to the combustors. A fuel is supplied to the combustor through one or more fuel nozzles and at least a portion of the compressed working fluid and the fuel are mixed to form a combustible fuel-air mixture. The fuel-air mixture is ignited in a combustion zone that is generally downstream from the fuel nozzles, thus creating a rapidly expanding hot gas. The hot gas flows from the combustor into the turbine. The hot gas imparts kinetic energy to multiple stages of rotatable blades that are coupled to a turbine shaft within the turbine, thus rotating the turbine shaft and producing work.

To increase turbine efficiency, modern combustors are operated at high temperatures which generate high thermal stresses on various components disposed within the combustor. As a result, at least a portion of the compressed working supplied to the combustor may be used to cool the various components. For example, many modern combustors may include a generally annular cap assembly that at least partially surrounds the one or more fuel nozzles. The cap assembly may generally provide structural support for the one or more fuel nozzles, and may at least partially define a flow path for the fuel-air mixture to follow just prior to entering the combustion zone. Certain cap assembly designs may include a generally annular cap plate that is disposed at a downstream end of the cap assembly and that is adjacent to the combustion zone. As a result, the cap plate is generally exposed to extremely high temperatures, thus resulting in high thermal stresses on the cap plate. In addition, high combustion dynamics resulting from pressure oscillations within the combustion zone may combine with the high thermal stresses to significantly limit the mechanical life of the cap plate.

Current cap assembly designs attempt to mitigate the high thermal stresses by directing a portion of the compressed working fluid to the cap assembly and through multiple cooling holes which extend through the cap plate surface. This method is known in the industry as effusion cooling. However, the compressed working fluid flowing through the multiple cooling holes may enter the combustion zone generally unmixed with the fuel. As a result, NOx and/or $CO_2$ generation may be exacerbated and turbine efficiency may be decreased. Therefore, a combustor that provides cooling to the cap assembly and improves pre-mixing of the compressed working fluid with the fuel for combustion would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor. The combustor generally includes a first shroud that extends circumferentially inside the combustor and that at least partially defines at least one inlet passage. A second shroud may extend generally circumferentially inside the combustor. The second shroud may be axially separated from the first shroud. The second shroud may at least partially define at least one outlet passage. A first plate may extend generally radially inside the second shroud downstream from the at least one inlet passage of the first shroud and upstream from the at least one outlet passage of the second shroud. The first plate may generally define at least one inlet port and at least one outlet port. A second plate may extend generally radially around the first plate downstream from the at least one inlet port and upstream from the at least one outlet port of the first plate. A first fluid flow path extends from the at least one inlet passage to the at least one inlet port, and a second fluid flow path extends from the at least one outlet port to the at least one outlet passage. A baffle may extend from the first shroud to the first plate, wherein the baffle may separate the first fluid flow path from the second fluid flow path.

Another embodiment of the present invention is a combustor having a first shroud that extends circumferentially inside the combustor. The first shroud may at least partially define at least one inlet passage. A second shroud may extend generally circumferentially inside the combustor. The second shroud may be generally axially separated from the first shroud. The second shroud may at least partially define at least one outlet passage. A first plate may be generally contiguous with the second shroud downstream from the at least one inlet passage of the first shroud and upstream from the at least one outlet passage of the second shroud. The first plate may generally define at least one inlet port and at least one outlet port. A second plate generally extends radially around the first plate downstream from the at least one inlet port and upstream from the at least one outlet port. A baffle generally extends from the first shroud to the first plate. An inlet plenum inside the first shroud may be at least partially defined by the first shroud, the baffle, and the first plate. An outlet plenum downstream from the inlet plenum may be at least partially defined by the second shroud, the baffle, and the first plate.

The present invention may also include a combustor having a first shroud that extends circumferentially inside the combustor. The first shroud may generally define at least one inlet passage. A second shroud extends generally circumferentially inside the combustor. The second shroud may be axially separated from the first shroud. The second shroud may at least partially define at least one outlet passage. A sleeve may at least partially circumferentially surround at least a portion of the second shroud to define a first annular passage between the second shroud and the sleeve. The at least one outlet passage may generally provide fluid communication through the second shroud to the first annular passage. A casing may at least partially surround at least a portion of the sleeve so as to define an outer annular passage between the casing and the sleeve. The at least one inlet passage may provide fluid communication from the outer annular passage through the shroud.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
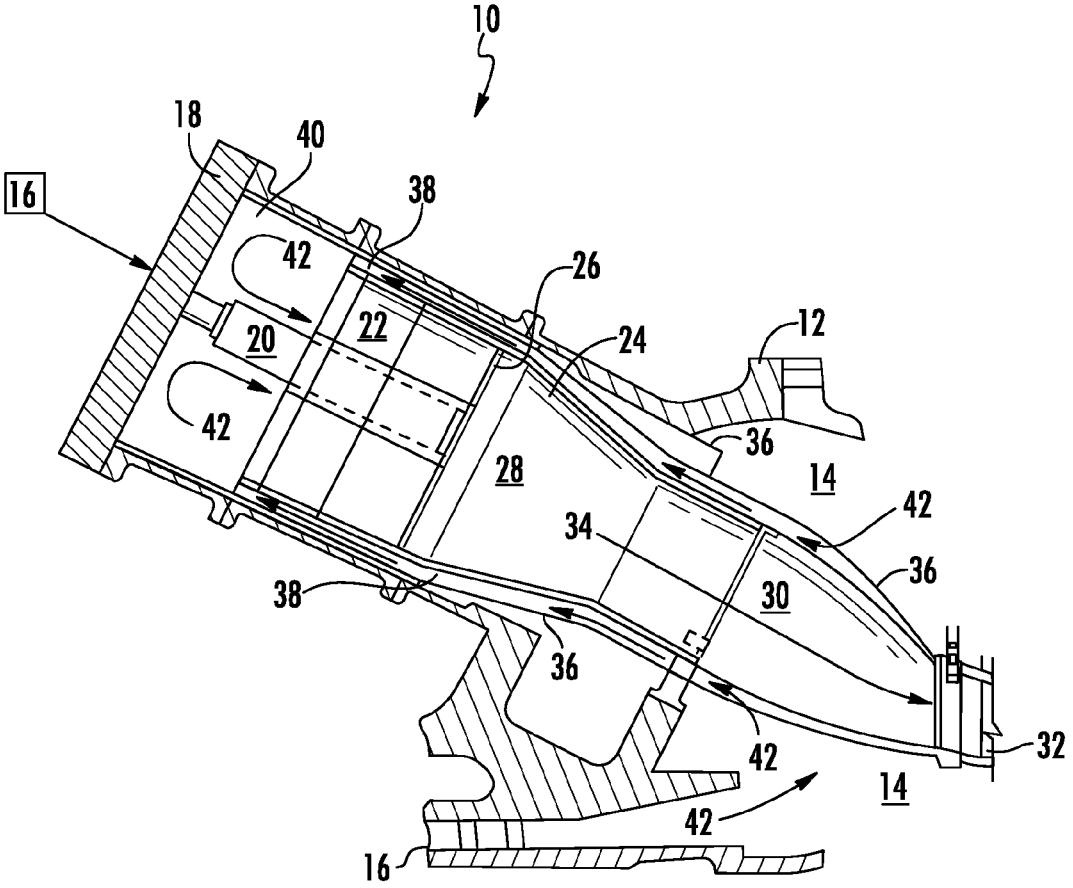
FIG. 1 is a simplified cross-section of an exemplary combustor that may incorporate various embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and a method for cooling the combustor. In particular embodiments, the combustor may generally include a first shroud that extends circumferentially and axially within the combustor. The first shroud may generally define at least one inlet passage. A second shroud may also extend generally radially within the combustor and may be axially separated from the first shroud. The second shroud may at least partially define at least one outlet passage. A first plate may extend generally radially within the second shroud generally downstream from the inlet passage and upstream from the outlet passage. The first plate may generally define at least one inlet port and at least one outlet port. A second plate may extend generally radially and circumferentially around the first plate downstream from the at least one inlet port and upstream from the at least one outlet port. A first fluid flow path may be generally defined between the at least one inlet of the first shroud and the at least one inlet port of the first plate. A second fluid flow path may be generally defined between the at least one outlet port to the at least one outlet passage. A baffle extends generally from the first shroud to the first plate so as to separate the first fluid flow path from the second fluid flow path.

In operation, a cooling medium may flow through the inlet passage, into the first fluid flow path. The cooling medium may pass through the at least one inlet port and may flow across the second plate, thereby cooling the second plate. The cooling medium may then flow through the at least one outlet port and into the second fluid flow path. The cooling medium may then exit the second fluid flow path through the at least one outlet passage of the second shroud. In particular embodiments, the at least one outlet passage may be at least partially surrounded by an annular sleeve that at least partially surrounds the second shroud and that at least partially defines an annular passage between the sleeve and the first and/or the second shrouds. In this manner, the cooling medium may be mixed with a compressed working fluid flowing through the annular passage so as to provide an air-fuel mixture for combustion within the combustor.

Figure 2:
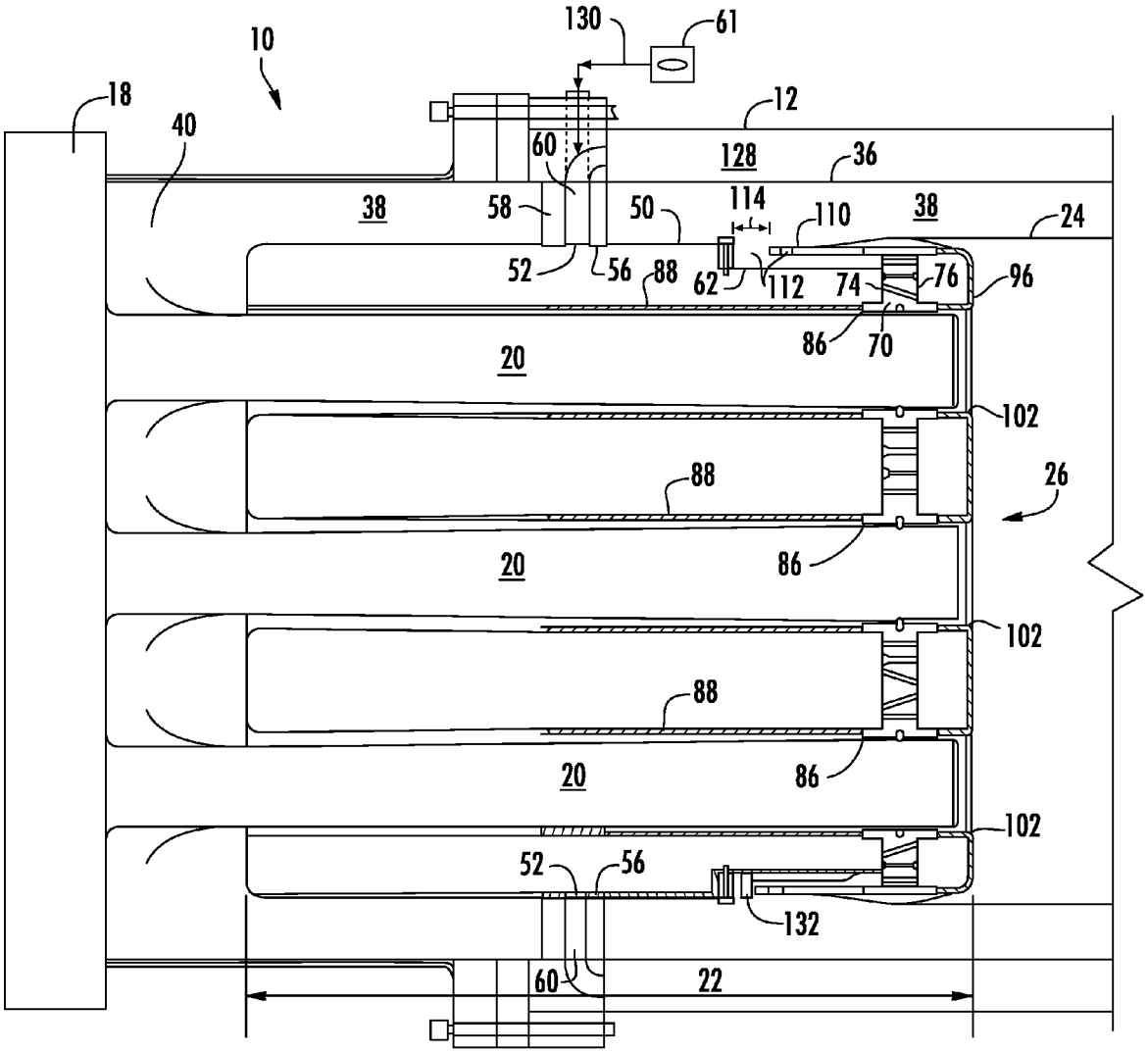
FIG. 2 is an enlarged cross section side view of a portion of the combustor as shown in FIG. 1, according to at least one embodiment of the present invention.

FIG. 1 provides a simplified cross-section view of an exemplary combustor 10, and FIG. 2 provides an enlarged cross section side view of a portion of the combustor 10 according to at least one embodiment of the present disclosure. As shown in FIG. 1, the combustor 10 may generally include one or more casings 12 that at least partially define a compressor discharge plenum 14 around the combustor 10. The compressor discharge plenum 14 may be in fluid communication with a compressor 16 (partially shown) positioned generally upstream from the combustor 10. An end cover 18 may be disposed at one end of the combustor 10. One or more fuel nozzles 20 may extend from the end cover 18 and at least partially through the combustor 10. The end cover 18 and/or the one or more fuel nozzles 20 may be in fluid communication with a fuel supply 16. A cap assembly 22 may extend generally radially and axially within at least a portion of the combustor 10 and may at least partially surround at least some of the one or more fuel nozzles 20.

A generally annular combustion liner 24 may surround a downstream end 26 of the cap assembly 22. The combustion liner 24 may extend generally axially through at least a portion of the combustor 10. A combustion zone 28 may be at least partially defined within the combustion liner 24 generally downstream from the cap assembly 22 downstream-end 26. A transition duct 30 may at least partially surround at least a portion of the combustion liner 24. The transition duct 30 may extend generally axially through the combustor 10 and may terminate at a point adjacent to one or more stationary nozzles 32. The combustion liner 24 and/or the transition duct 30 may at least partially define a hot gas path 34 that extends generally axially through the combustor 10. Although a combustion liner 24 is shown and described, it should be known to one of ordinary skill in the art that in alternate combustor 10 configurations, the transition duct 30 may surround the downstream end 26 of the cap assembly 22, extend axially through the combustor 10 and terminate at a point adjacent to plurality of stationary nozzles 32, thereby eliminating the necessity for the combustion liner 24.

In particular embodiments, as shown in FIG. 1, one or more sleeves 36 may at least partially surround the cap assembly 22, the transition duct 30 and/or the combustion liner 24 so as to at least partially define an annular passage 38 therebetween. In addition or in the alternative, the annular passage 38 may be at least partially defined between the combustion liner 24 and/or the transition duct 30, the cap assembly 22 and at least one of the one or more casings 12 that surround the combustor 10. A head end 40 of the combustor 10 may be at least partially defined between the end cover 18, at least one of the one or more casings 12 and a portion the cap assembly 22. The annular passage 38 may provide fluid communication between the compressor discharge plenum 14 and the head end 40.

In operation, a compressed working fluid 42 such as air may flow from the compressor 16 into the compressor discharge plenum 14. Generally, a primary portion of the compressed working fluid 42 flows across the transition duct 30 and or the combustion liner 24, through the annular passage 38 and into the head end 40 of the combustor 10. As the primary portion of the compressed working fluid 42 flows through the annular passage 38, friction with at least one of the transition duct 30, the combustion liner 24 or the one or more sleeves 36 and/or other flow obstructions throughout the annular passage 38, may generally result in a substantial pressure drop in the primary portion of the compressed working fluid 42 as it flows across the cap assembly 22 and towards the head end 40 of the combustor 10.

At least some of the primary portion of the compressed working 42 fluid may reverse direction at the end cover 18 and may flow through at least a portion of the cap assembly 22 and/or the one or more fuel nozzles 20. The primary portion of the compressed working fluid 42 may pre-mix with a fuel from the fuel supply 16 and may be injected through the one or more fuel nozzles 20, thereby providing a fuel-air mixture for combustion within the combustion zone 28. The fuel-air mixture flows into the combustion zone 28 where it is burned to provide a rapidly expanding hot gas. The hot gas flows along the hot gas path 34 and across the one or more stationary nozzles 32 as it exits the combustor 10. As the fuel-air mixture is burned in the combustion zone 28, a flame and/or a portion of the hot gas may reside proximate to the downstream end 26 of the cap assembly 22, thereby resulting in extremely high thermal stresses at the downstream end 26 of the cap assembly 22.

Figure 3:
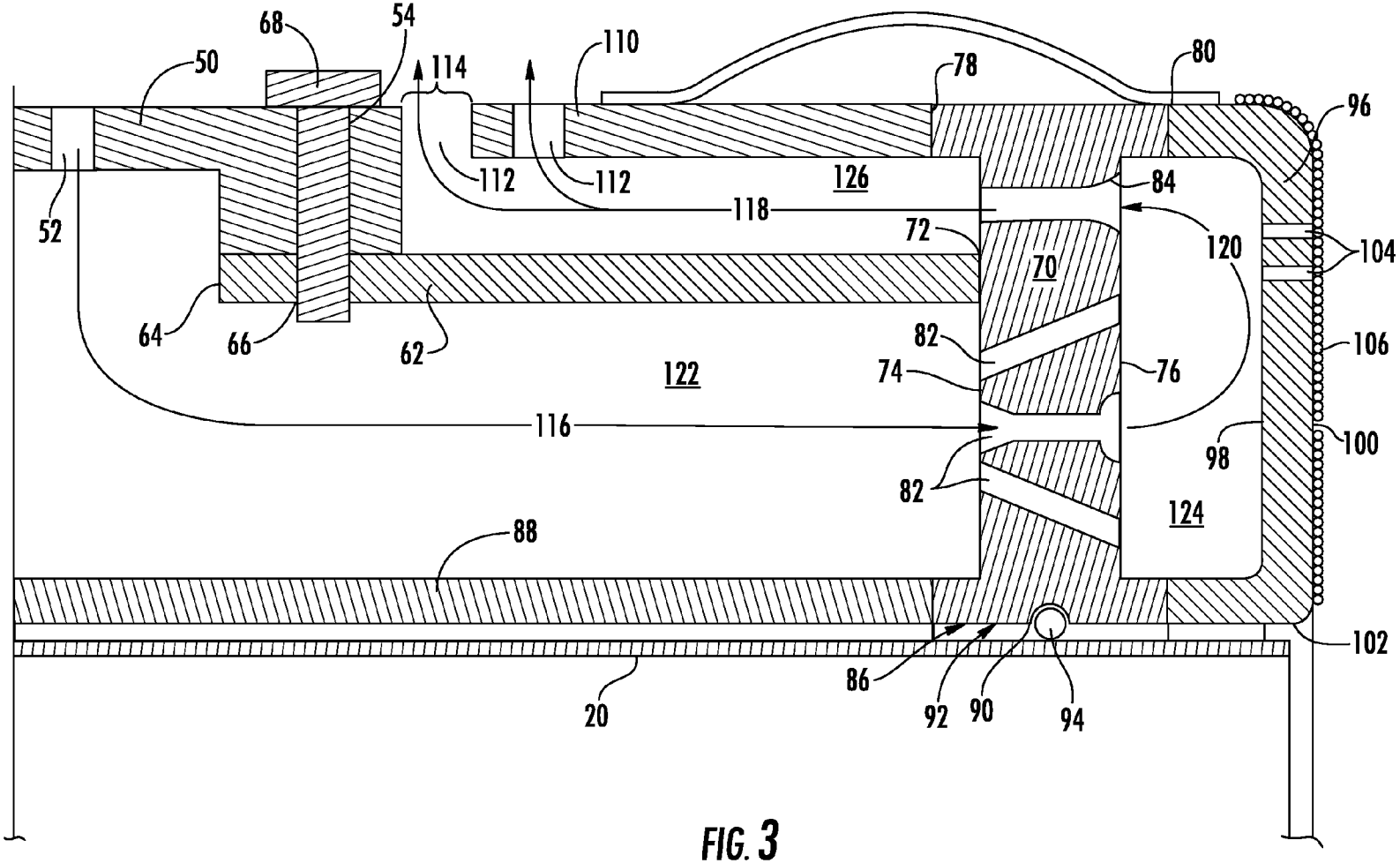
FIG. 3 is an enlarged cross section side view of a portion of the combustor as shown in FIG. 2, according to at least one embodiment of the present disclosure.

FIG. 3 provides an enlarged cross section side view of a downstream portion the cap assembly 22 as shown in FIG. 2. As shown in FIGS. 2 and 3, the cap assembly 22 may generally include a first shroud 50 that extends generally circumferentially within the combustor 10. The first shroud 50 may define at least one inlet passage 52. The at least one inlet passage 52 may extend generally radially through the first shroud 50. In particular embodiments, as shown in FIG. 3, the first shroud 50 may further define one or more pin slots 54 that extend generally radially through the first shroud 50.

In particular embodiments, as show in FIG. 2, the first shroud 50 may be coupled to a support ring 56. The support ring 56 may be at least partially coupled to the one or more casings 12. The support ring 56 may include one or more struts 58 that extend generally radially outward from the radial support ring 56. At least some of the one or more struts 58 may extend radially through the annular passage 38. The support ring 56 and at least some of the one or more struts 58 may at least partially define a cooling flow passage 60 that extends generally radially through the at least some of the one or more struts 58. In particular embodiments, as shown in FIG. 2, the cooling flow passages 60 may be axially and/or radially aligned with the at least one inlet passage 52 of the first shroud 50, thereby defining a continuous flow path through the one or more struts 58 and the first shroud 50. In addition or in the alternative, the one or more cooling flow passages 60 and/or the at least one inlet passage 52 of the first shroud 50 may be fluidly connected to an external cooling medium supply 61.

In particular embodiments, as shown in FIGS. 2 and 3, a generally annular baffle 62 may extend downstream from the first shroud 50. As shown, the baffle 62 may be generally smaller than the first shroud 50. For example, but not by way of limitation, the baffle 62 may have a smaller diameter than the first shroud 50. In particular embodiments, a first end 64 of the baffle 62 may be configured to be coupled to the first shroud 50. For example, the baffle 62 may define one or more pin slots 66 generally adjacent to the first end 64, where each of the one or more pin slots 66 of the baffle 62 are generally aligned with each of the one or more pin slots 54 of the first shroud 50. In this manner, a pin 68 may be inserted into the pin slots 54, 66 to couple the first shroud 50 and the baffle 62. In the alternative, the baffle 62 may be welded or brazed to the first shroud 50. In further embodiments, the baffle 62 and the first shroud 50 may be cast and/or machined as a unitary component.

As shown in FIGS. 2 and 3, the cap assembly 22 may further include a first plate 70 that extends generally radially and/or circumferentially within the combustor 10 downstream from the first shroud 50. In particular embodiments, as shown in FIG. 3, the first plate 70 may be connected to a second end 72 of the baffle 62. The second end 72 of the baffle 62 may be connected to the first side 74 of the first plate 70 by any means known in the art sufficient to withstand the operating environment within the combustor 10. For example, the baffle 62 may be welded or brazed to the first side 74 of the first plate 70. The first plate 70 may generally include a first side 74 axially separated from a second side 76. In particular embodiments, the first side 74 may include a first periphery edge 78 that extends generally circumferentially around the first side 74 of the first plate 70. A second periphery edge 80 may extend generally circumferentially around the second side 76 of the first plate 70. In particular embodiments, the first periphery edge 78 may extend generally axially away from the first side 74 of the first plate 70. In addition or in the alternative, the second periphery edge 80 may extend generally axially away from the second side 76 of the first plate 70.

As shown in FIG. 3, the first plate 70 may define at least one inlet port 82 and at least one outlet port 84. The at least one inlet port 82 may extend generally axially through the first plate 70. The at least one inlet port 82 may be generally cylindrical, conical, oval or any shape or any combination of shapes or any size which may encourage fluid flow through the first plate 70. In particular embodiments, at least one of the at least one inlet port 82 may intersect with the second side 76 of the first plate 70 at an angle that is substantially perpendicular with the second side 76. In addition or in the alternative, at least one of the at least one inlet ports 82 may intersect the second side 76 of the first plate 70 at an acute angle relative to the second side 76. In particular embodiments, the at least one inlet port 82 may be disposed radially inward from the baffle 62.

As shown in FIG. 3, the at least one outlet port 84 may extend generally axially through the first plate 70. The at least one outlet port 84 may be generally cylindrical, conical, oval or any shape or any combination of shapes or any size which may encourage fluid flow through the first plate 70. At one of the at least one outlet port 84 may intersect with the second side 76 of the first plate 70 at an angle that is substantially perpendicular with the second side 76. In addition or in the alternative, at least one of the at least one outlet port 84 may intersect the second side 76 of the first plate 70 at an acute angle relative to the second side 76. In particular embodiments, the at least one outlet port 84 may be disposed radially outward from the baffle 62. In various embodiments, the at least one outlet port 84 may be disposed between the baffle 62 and the first periphery edge 78 of the first side 74 of the first plate 70.

As shown in FIGS. 2 and 3, the first plate 70 may further define one or more fuel nozzle passages 86 that extend generally axially through the first plate 70. In particular embodiments, the one or more fuel nozzle passages 86 may be circumferentially surrounded by the baffle 62. In various embodiments, the one or more fuel nozzle passages 86 may be generally coaxial with the one or more fuel nozzles 20. A fuel nozzle flow sleeve 88 may at least partially surround each or some of the one or more fuel nozzle passages 86 of the first plate 70. In particular embodiments, the fuel nozzle flow sleeves 88 may be generally coaxial with the one or more fuel nozzle passages 86 of the first plate 70. The fuel nozzle flow sleeves 88 may be surrounded by the baffle 62. As shown in FIG. 2, the fuel nozzle flow sleeves 88 may extend generally axially towards the head end 40 of the combustor 10 from the first side 74 of the first plate 70. The fuel nozzle flow sleeves 88 may be cast and/or machined as an integral part of the first plate 70. In the alternative, the fuel nozzle flow sleeves 88 may be separate components coupled to the first plate 70 circumferentially around the one or more fuel nozzle passages 86.

As shown in FIG. 3, the first plate 70 may define one or more seal slots 90 that extend at least partially circumferentially around an inner surface 92 of some or all of the first plate 70 fuel nozzle passages 86. A radial seal 94 such as a piston seal may be disposed within each or some of the seal slots 90. In this manner, each or some of the radial seals 94 may be sealing engaged with one of the one or more fuel nozzles 20 that extend through the one or more fuel nozzle passages 86 of the first plate 70.

In particular embodiments, as shown in FIGS. 2 and 3, the cap assembly 22 may further include a second plate 96. As shown in FIG. 2, the second plate 96 may extend generally radially around the first plate 70 second side 76. In this manner, as shown in FIG. 3, the second plate 96 may be downstream from the at least one inlet port 82 and upstream from the at least one outlet port 84. The second plate 96 may be connected to the first plate 70 second side 76 or to the first plate 70 second peripheral edge 80. Although a generally cylindrical second plate 96 is shown in FIG. 2, it should be obvious to one of ordinary skill in the art that the second plate 96 may be any shape that is generally complementary to the first plate 70. For example, but not limiting of, the second plate 96 may be wedge shaped, oval or any non-round shape. As shown in FIG. 3, the second plate 96 may generally include an upstream side 98 herein referred to as "the cold side 98" axially separated from a downstream side 100 herein referred to as the "the hot side 100".

In particular embodiments, as shown in FIGS. 2 and 3, the second plate 96 may at least partially define one or more fuel nozzle passages 102 that extend generally axially through the second plate 96. The one or more fuel nozzle passages 102 may be generally coaxial with the first plate 70 one or more fuel nozzle passages 86. In this manner, the one or more fuel nozzles 20 may pass substantially through the cap assembly 22 and terminate at a point generally adjacent to the downstream end 26 of the cap assembly 22. In alternate embodiments, as shown in FIG. 3, the second plate 96 may define a plurality of cooling passages 104 that extend substantially axially through the second plate 96 so as to provide fluid communication through the second plate 96 from the cold side 98 to the hot side 100. In addition or in the alternative, at least a portion of the hot side 100 of the second plate 96 may be coated with a heat resistant material 106 such as a thermal barrier coating in order to reduce thermal stresses on the second plate 96.

A second shroud 110, as shown in FIGS. 2 and 3, may at least partially circumferentially surround the baffle 62. As shown in FIG. 3, the second shroud 110 may extend from the first plate 70 towards the first shroud 50. In particular embodiments, the second shroud 110 may extend from the first peripheral edge 78 of the first plate 70. In alternate embodiments, the second shroud 110 may extend from the first plate 70 first side 74. In further embodiments, the second shroud 110 may at least partially circumferentially surround the first plate 70. For example, in this configuration the first plate 70 may extend generally radially within the second shroud 110. In alternate embodiments, the second shroud 110 may be at least partially defined by the first plate 70. For example, the first periphery edge 78 may extend generally axially away from the first side 74 of the first plate 70 towards the first shroud 50. In certain embodiments, the first shroud 50 and the second shroud 110 may be joined and/or may be a single component. As shown in FIG. 3, the second shroud 110 may at least partially define at least one outlet passage 112. The at least one outlet passage 112 may extend generally radially through the second shroud 110. In addition or in the alternative, the at least one outlet passage 112 may be at least partially defined by an axial gap 114 formed between the first and second shrouds 50, 110. In particular embodiments, the at least one outlet passage 112 may be in fluid communication with the annular passage 38 of the combustor 10.

As shown in FIG. 3, a first fluid flow path 116 may extend between the at least one inlet passage 52 of the first shroud 50 and the at least one inlet port 82 of the first plate 70. The first fluid flow path 116 may be at least partially defined by the first shroud 50, the baffle 62 and the first plate 70. In alternate embodiments, the first fluid flow path 116 may be further defined by the fuel nozzle flow sleeves 88.

A second fluid flow path 118 may extend from the at least one outlet port 84 of the first plate 70 to the at least one outlet passage 112. The second fluid flow path 118 may be at least partially defined by the baffle 62, the second shroud 110 and the first plate 70. The second fluid flow path 118 extends generally downstream in relation to the direction of a fluid flowing from the at least one outlet port 84 of the first plate 70. As shown, the baffle 62 provides a barrier/separation between the first and the second fluid flow paths 116, 118. In addition, the second fluid flow path 118 may be further defined by the first shroud 50. In particular embodiments a third fluid flow path 120 may extend between the at least one inlet port 82 of the first plate 70 and the at least one outlet port 84 of the first plate 70. The third fluid flow path 120 may be at least partially defined by the first plate 70 second side 76 and the second plate 96 cold side 98. The first, second and third fluid flow paths 116, 118, 120, may define a single continuous cooling flow path that extends through the cap assembly 22.

Figure 4:
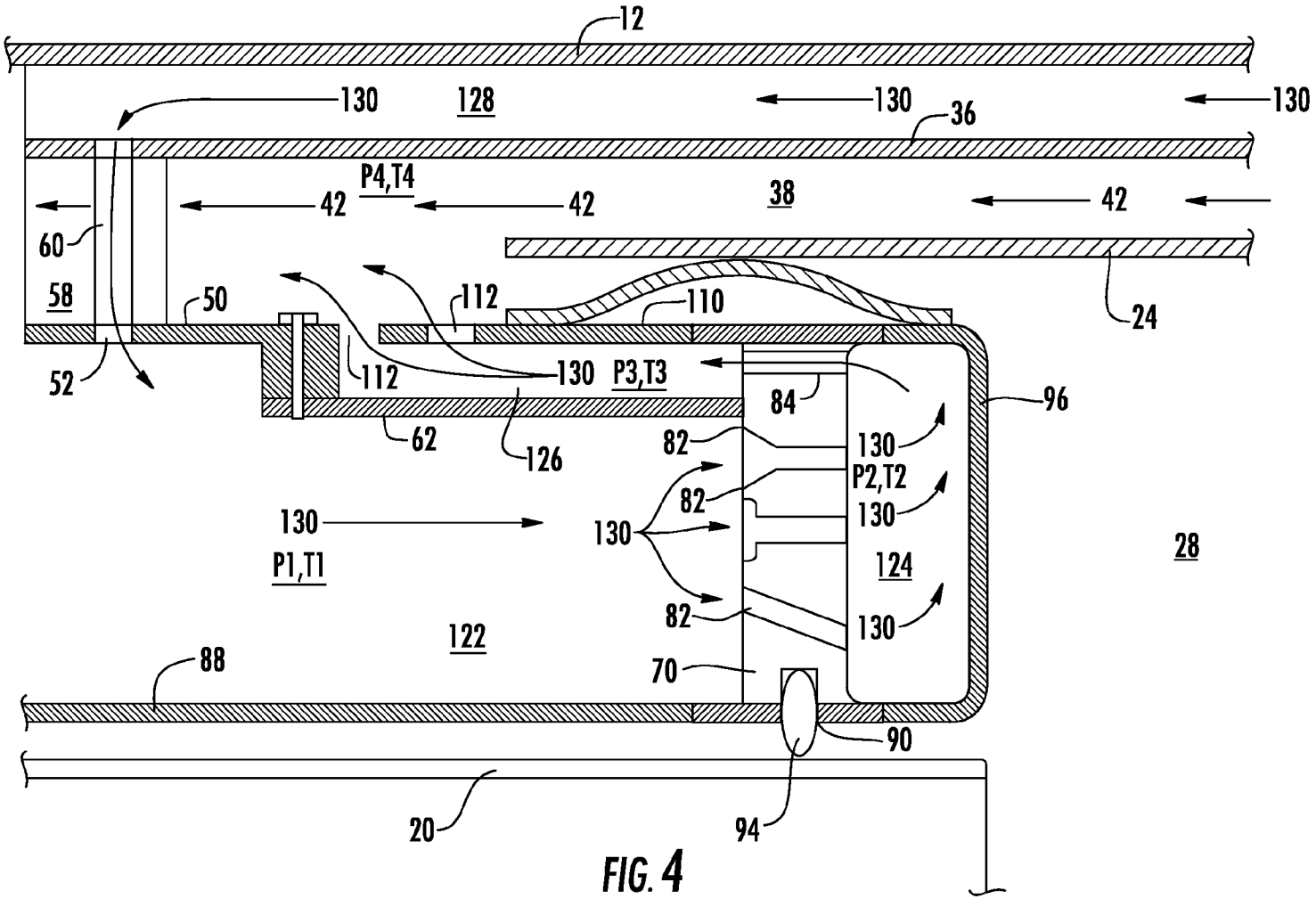
FIG. 4 is an enlarged cross section side view of a portion of the combustor as shown in FIG. 2, according to at least one embodiment of the present disclosure.

FIG. 4 provides an enlarged cross section of a portion of the cap assembly 22 as shown in FIG. 2. As shown in FIGS. 3 and 4, one or more plenums may be defined within the cap assembly. An inlet plenum 122 may be at least partially defined by the first shroud 50, the baffle 62 and the first plate 70. In alternate embodiments, the inlet plenum 122 may be further defined by the fuel nozzle sleeves 88. The inlet plenum 122 may be in fluid communication with the at least one inlet passage 52 of the first shroud 50. An intermediate plenum 124 may be at least partially defined by the first plate 70 and the second plate 96. The intermediate plenum 124 is generally downstream from the inlet plenum 122. The at least one inlet port 82 of the first plate 70 may provide fluid communication between the inlet plenum 122 and the intermediate plenum 124. An outlet plenum 126 may be at least partially defined by the first plate 70, the second shroud 110 and the baffle 62. The outlet plenum 126 is generally downstream from the intermediate plenum 124. The at least one outlet port 84 of the first plate 70 may provide fluid communication between the intermediate plenum 124 and the outlet plenum 126.

In particular embodiments, as shown in FIGS. 2 and 4, an outer annular passage 128 may be at least partially defined between the one or more sleeves 36 that at least partially surround the cap assembly 22 and one or more of the one or more casings 12 of the combustor 10. The outer annular passage 128 may be in fluid communication with at least one of the compressor discharge plenum 14, the compressor 16 or the external cooling medium supply 61. In particular embodiments, the at least one inlet passage 52 of the first shroud 50 may be in fluid communication with the outer annular passage 128. In addition or in the alternative, the cooling passages 60 of the one or more struts 58 may provide fluid communication between the outer annular passage 128 and the inlet plenum 122 of the cap assembly 22.

In one embodiment, as shown in FIG. 4, a pressurized cooling medium 130 such as a secondary portion of the compressed working fluid may flow through the outer annular passage 128, through the cooling passages 60 of the one or more struts 58 and/or the at least one inlet passage 52 of the first shroud 50 and into the inlet plenum 122. In addition or in the alternative, the cooling medium 130 may enter the inlet plenum 122 through any portion of the cap assembly 22. The cooling medium 130 may flow through the inlet plenum 122 along the first fluid flow path 116 at a first pressure P1 and at a first temperature T1. The cooling medium may then flow through the at least one inlet port 82 and into the intermediate plenum 124. As the cooling medium 130 flows from the inlet plenum to the intermediate plenum 124 a pressure drop may occur. As a result, the cooling medium in the intermediate plenum may be at a second pressure P2 which may be lower than the first pressure P1 of the cooling medium 130 flowing through the first fluid flow passage. The at least one inlet port 82 may direct the cooling medium 130 at an angle substantially perpendicular to the cold side of the second plate 96, thereby providing impingement cooling to the second plate 96. In addition or in the alternative, the at least one inlet port may direct the cooling medium 130 against the cold side 98 of the second plate 96 at an acute angle relative to the second side 76 of the first plate 70, thereby providing at least one of impingement, convective or conductive cooling to the second plate 96 and/or the intermediate plenum 124.

Heat energy may be transferred from the second plate 96 to the cooling medium 130. As result, the temperature of the cooling medium 130 may be increased to a second temperature T2. The cooling medium 130 may flow along the third fluid flow path 120 and from the intermediate plenum 124 at the second pressure P2 and the second temperature T2 through the at least one outlet port 84 and into the outlet plenum 126. As the cooling medium 130 flows through the at least one outlet port 84 and into the outlet plenum 126, a further pressure drop of the cooling medium 130 may occur. As the cooling medium 130 flows into the outlet plenum and along the second fluid passage at a third pressure P3, the cooling medium 130 may continue to provide a cooling effect to the second shroud 110 and/or the first plate 70, thereby further increasing the temperature of the cooling medium 130 to a third temperature T3.

A primary portion of the compressed working fluid 42 that flows through the annular passage 38 may encounter friction losses as it flows across and/or around at least some or all of the transition duct 30, the combustion liner 24 and the one or more flow sleeves 36. In addition, the primary portion of the compressed working fluid 42 may encounter other flow obstructions throughout the annular passage that further. Consequently, a substantial pressure drop in the primary portion of the compressed working fluid 42 flowing across the cap assembly 22 may occur. Accordingly, the pressure of the primary portion of the compressed working fluid in the annular passage 38, herein referred to as P4, may be generally less than the third pressure P3 of the cooling medium 130 flowing through the second fluid flow passage. As a result, the cooling medium 130 used to cool the second plate 96 may enter the annular passage through the outlet passage 112 and/or the axial gap 114 and combine with the primary portion of the compressed working fluid flowing 42 towards the head end 40 of the combustor 10. In this manner, effective cooling of the second plate 96 may extend the overall mechanical life of the cap assembly 50 and/or the combustor 10 and may decrease outage time for operators, thus resulting in a possible reduction in operating costs. In addition or in the alternative, by circulating the cooling medium 130 into the flow of the primary portion of the compressed working fluid 42, more complete mixing of the fuel and the primary portion of the compressed working fluid 42 and/or the cooling medium 130 may occur, thereby resulting in enhanced overall gas turbine efficiency. In addition or in the alternative, the combustor 10 may produce lower undesirable emissions, such as nitrous oxides (NOx) and/or carbon dioxide (CO2).

Figure 5:
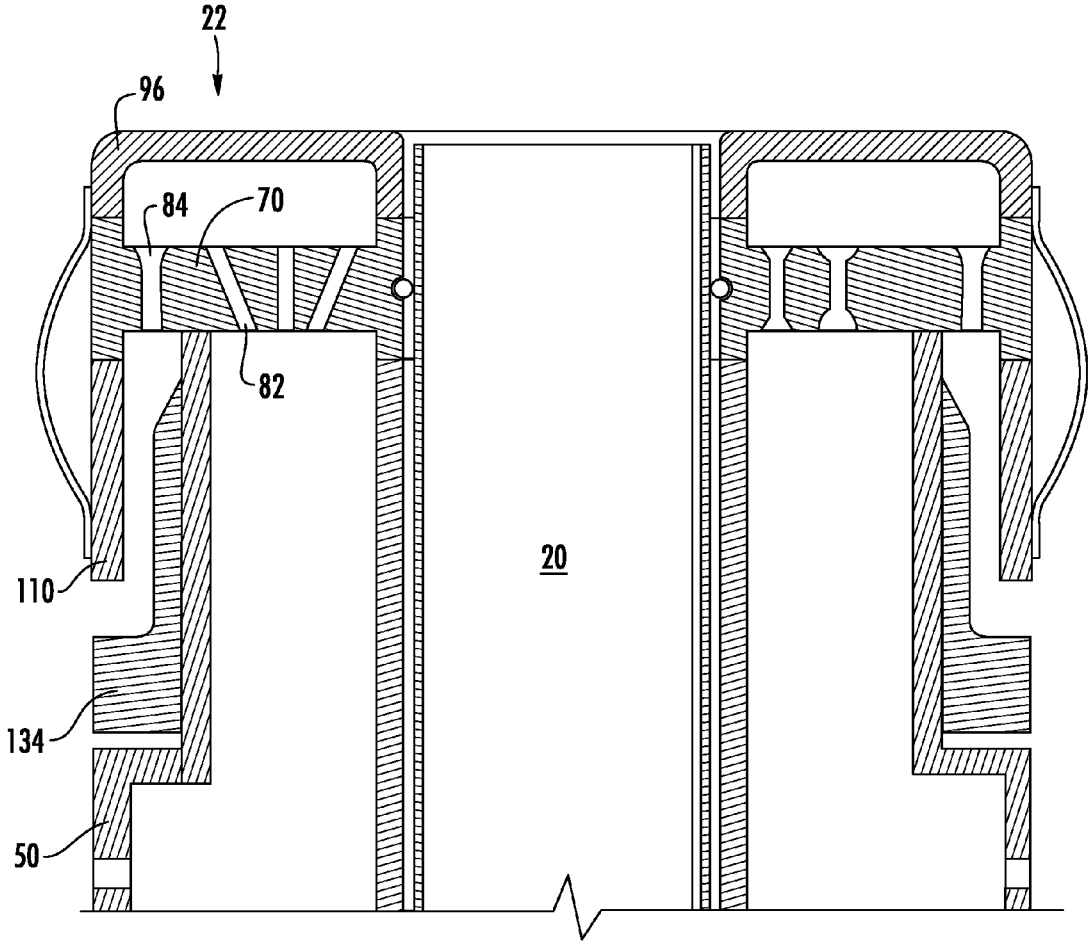
FIG. 5 is an enlarged cross section side view of an alternate embodiment of the combustor as shown in FIG. 2, according to at least one embodiment of the present disclosure.

In further embodiments, as shown in FIG. 5, the cap assembly 22 structure described herein may be used in a single fuel nozzle 20 combustor 10. In particular embodiments, as shown in FIGS. 1 and 5, an outer seal 132 may be disposed at least partially within the second fluid passage, thereby reducing leakage of the primary portion of the compressed working fluid 42 from the annular passage 38 into the second fluid passage as the combustor 10 cycles through various operating conditions.

One of ordinary skill in the art will readily appreciate from the teachings herein that the various embodiments shown and described with respect to FIGS. 2-4 may also provide a method for cooling the combustor 10. The method generally includes flowing the cooling medium 130 into the inlet plenum 122 and through the first fluid flow path at a first pressure. The cooling medium 130 may then flow through the at least one inlet port 82, through the first plate 70 and into the intermediate plenum. The cooling medium 130 may be directed against the second plate 96 at an angle that is substantially perpendicular to the second plate 96. In the alternative, the cooling medium 130 may intersect with the second plate 96 at an angle that is acute to the second plate 96. The cooling medium 130 may flow along the third fluid flow path, through the first plate and into the outlet plenum 126 at a third pressure. The cooling medium 130 may then flow through the second fluid flow passage and may exit through the at least one outlet passage 112 of the second shroud 110. The cooling medium 130 may then flow into the annular passage 38 and may be mixed with the primary portion of the compressed working fluid 42 flowing through the annular passage 38 and towards the head end of the combustor 10. In addition or in the alternative, the cooling medium 130 may flow from the external cooling medium 130 supply 61 and into the inlet plenum 122.

This written description uses examples to disclose the invention, including the best mode, and also to enable any person skilled in the art to practice the invention, including making and using any devices or combustors and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

an end cover coupled to a casing and a plurality of fuel nozzles disposed within the casing, wherein the plurality of fuel nozzles extend axially downstream from the end cover with respect to an axial centerline of the combustor;

a cap assembly axially spaced from the end cover, at least partially surrounding the plurality of fuel nozzles and disposed within the casing, the cap assembly comprising:

an annular shaped first shroud coaxially aligned with the axial centerline of the combustor and radially spaced from the casing so as to partially define an annular passage therebetween, wherein the first shroud defines at least one inlet passage;

an annular shaped second shroud coaxially aligned with the axial centerline of the combustor and axially offset from the first shroud;

a first plate that extends radially and circumferentially across one end of the second shroud, wherein the first plate is coupled to the first shroud via a baffle plate that is set radially inwardly from the second shroud so as to define an outlet plenum therebetween, wherein the first plate, the first shroud, and the baffle plate at least partially define an inlet plenum therebetween, wherein the first plate defines a plurality of fuel nozzle passages, each fuel nozzle passage being axially aligned with a respective fuel nozzle of the plurality of fuel nozzles, wherein the first plate defines a plurality of inlet ports in fluid communication with the inlet plenum and at least one outlet port in fluid communication with the outlet plenum; and a second plate axially spaced from the first plate and connected to a periphery edge of the first plate, wherein the first plate and the second plate define an intermediate plenum therebetween, wherein the plurality of inlet ports and the at least one outlet port are in fluid communication with the intermediate plenum.

2. The combustor as in claim 1, wherein a portion of the second plate that defines the intermediate plenum is non-perforated.

3. The combustor as in claim 1, wherein the second plate defines a plurality of fuel nozzle passages, each fuel nozzle passage being aligned with a respective fuel nozzle of the plurality of fuel nozzles.

4. The combustor as in claim 1, wherein the plurality of inlet ports is disposed radially inward from the baffle and the at least one outlet port is disposed radially outward from the baffle.

5. The combustor as in claim 1, wherein at least one of the inlet ports of the plurality of inlet ports is angled with respect to the axial centerline of the combustor.

6. The combustor as in claim 1, wherein the plurality of inlet ports is oriented so as to direct a flow of a cooling medium against a cold side surface of the second plate.

7. The combustor as in claim 1, further comprising an annular shaped sleeve coaxially aligned with and radially spaced from the second shroud so as to further define the annular passage therebetween, wherein the annular passage is in fluid communication with the outlet plenum.

8. The combustor as in claim 7, wherein the annular passage is in fluid communication with a head end portion of the combustor.

9. The combustor as in claim 7, further comprising an outer seal disposed within the outlet plenum, wherein the outer seal restricts flow of a cooling medium from entering the outlet plenum from the annular passage.

10. The combustor as in claim 1, further comprising a plurality of fuel nozzle flow sleeves, wherein each fuel nozzle flow sleeve is axially aligned with and circumferentially surrounds at least a portion of a respective fuel nozzle of the plurality of fuel nozzles, wherein each fuel nozzle flow sleeve is connected to the first plate and wherein the plurality of fuel nozzle flow sleeves at least partially define the inlet plenum.

11. A combustor, comprising:

an end cover coupled to a casing and a fuel nozzle disposed within the casing, wherein the fuel nozzle extends axially downstream from the end cover with respect to an axial centerline of the combustor;

a cap assembly axially spaced from the end cover at least partially surrounding the fuel nozzle and disposed within the casing, the cap assembly comprising:

an annular shaped first shroud coaxially aligned with the axial centerline of the combustor and radially spaced from the casing so as to partially define an annular passage therebetween, wherein the first shroud defines at least one inlet passage;

an annular shaped second shroud coaxially aligned with the axial centerline of the combustor and axially offset from the first shroud;

a first plate that extends radially and circumferentially across one end of the second shroud, wherein the first plate is coupled to the first shroud via a baffle plate that is set radially inwardly from the second shroud so as to define an outlet plenum therebetween, wherein the first plate, the first shroud, and the baffle plate at least partially define an inlet plenum therebetween, wherein the first plate defines a plurality of fuel nozzle passages, each fuel nozzle passage being aligned with a respective fuel nozzle of the plurality of fuel nozzles, wherein the first plate defines a plurality of inlet ports in fluid communication with the inlet plenum and at least one outlet port in fluid communication with the outlet plenum; and a second plate axially spaced from the first plate and connected to a periphery edge of the first plate, wherein the first plate and the second plate define an intermediate plenum therebetween, wherein the plurality of inlet ports and the at least one outlet port are in fluid communication with the intermediate plenum.

12. The combustor as in claim 11, wherein a portion of the second plate that defines the intermediate plenum is non-perforated.

13. The combustor as in claim 11, wherein the second plate defines a fuel nozzle passage aligned with the fuel nozzle.

14. The combustor as in claim 11, wherein the plurality of inlet ports is disposed radially inwardly from the baffle and the at least one outlet port is disposed radially outwardly from the baffle.

15. The combustor as in claim 11, wherein at least one of the inlet ports of the plurality of inlet ports is angled with respect to the axial centerline of the combustor.

16. The combustor as in claim 11, wherein the plurality of inlet ports is oriented so as to direct a flow of a cooling medium against a cold side surface of the second plate.

17. The combustor as in claim 11, further comprising an annular shaped sleeve coaxially aligned with and radially spaced from the second shroud so as to further define the annular passage therebetween, wherein the annular passage is in fluid communication with the outlet plenum.

18. The combustor as in claim 17, wherein the annular passage is in fluid communication with a head end portion of the combustor.

19. The combustor as in claim 17, further comprising an outer seal disposed within the outlet plenum, wherein the outer seal restricts flow of a cooling medium from entering the outlet plenum from the annular passage.

20. The combustor as in claim 11, further comprising a fuel nozzle flow sleeve, wherein the fuel nozzle flow sleeve is axially aligned with and circumferentially surrounds at least a portion of the fuel nozzle, wherein the fuel nozzle flow sleeve is connected to the first plate and wherein the fuel nozzle flow sleeve at least partially defines the inlet plenum.

* * * * *